US006015318A

United States Patent [19]

Uematsu et al.

[11] Patent Number: 6,015,318

[45] Date of Patent: Jan. 18, 2000

[54] HYDRAULIC TILT AND TRIM UNIT FOR MARINE DRIVE

[75] Inventors: Yoshikatsu Uematsu; Naoyoshi Kuragaki; Kazuya Takeuchi, all of Shizuoka, Japan

[73] Assignee: Yamaha Hatsudoki Kabushiki Kaisha, Japan

[21] Appl. No.: 09/009,043

[22] Filed: Jan. 20, 1998

[30] Foreign Application Priority Data

Jan. 17, 1997 [JP] Japan ..... 9-006754

[51] Int. Cl.[7] ..... B63H 5/12

[52] U.S. Cl. ..... 440/61; 440/53

[58] Field of Search ..... 440/53, 61; 114/150; 91/444–447

[56] References Cited

U.S. PATENT DOCUMENTS

| | | | |
|---|---|---|---|
| 3,842,789 | 10/1974 | Bergstedt | 440/61 |
| 4,557,696 | 12/1985 | Nakahama | 440/61 |
| 4,695,260 | 9/1987 | Suzuki et al. | 440/61 |
| 4,702,714 | 10/1987 | Nakase | 440/61 |
| 4,778,414 | 10/1988 | Taguchi | 440/61 |
| 4,813,896 | 3/1989 | Koike et al. | 440/61 |
| 4,909,766 | 3/1990 | Taguchi | 440/61 |
| 4,990,111 | 2/1991 | Saitoh et al. | 440/61 |
| 5,007,866 | 4/1991 | Okita | 440/61 |
| 5,018,994 | 5/1991 | Okita | 440/61 |
| 5,049,099 | 9/1991 | Ito et al. | 440/61 |
| 5,067,919 | 11/1991 | Okita | 440/61 |
| 5,366,393 | 11/1994 | Uenage et al. | 440/1 |

*Primary Examiner*—Jesus D. Sotelo

*Attorney, Agent, or Firm*—Knobbe, Martens, Olson & Bear, LLP

[57] ABSTRACT

An improved flow control mechanism for a tilt and trim adjustment system quickens tilt and trim operations of an associated outboard drive. The flow control mechanism includes a bypass line that interconnects the two sides of a respective tilt and trim cylinder. A bypass valve regulates flow through the bypass line. The bypass valve opens the bypass line when raising the outboard drive to quicken this operation. When lowering the outboard drive, however, the bypass valve closes the bypass line and connects an up chamber of the cylinder to a suction side of the pump to slow the speed at which the tilt and trim adjustment system lowers the outboard drive. The flow control mechanism also inhibits the flow of working fluid through the system when the pump is inactive.

20 Claims, 4 Drawing Sheets

HYDRAULIC TILT AND TRIM UNIT FOR MARINE DRIVE

BACKGROUND OF THE INVENTION

1. Field of the Invention

This invention relates to a marine propulsion unit for a watercraft, and more particularly to a hydraulic tilt and trim adjustment system for a marine propulsion unit.

2. Description of Related Art

The optimal trim angle of an outboard drive varies with a watercraft's running condition. For instance, the bow of the watercraft should press against the water when accelerating from rest or from a slow speed. To achieve this condition, the angle of the propeller shaft is disposed at a negative angle relative to the horizontal (i.e., at a negative trim angle). A thrust vector produced by the propeller in this position is thus out of the water. When running at high speed, the propeller is raised or trimmed to position the propeller shaft at a positive trim angle relative to the horizontal within the range of about 0° to 15°. The outboard drive also must be raised beyond the normal trim range in order to operate in shallow water and for storage in a full tilt-up position A hydraulic tilt and trim adjustment system often adjusts the trim and tilt position of the outboard drive. The tilt and trim adjustment system usually includes at least one hydraulic actuator which essentially operates between the watercraft transom and the outboard drive unit. The actuator causes the outboard drive to pivot about a horizontal axis to raise or lower the outboard drive.

Tilt and trim adjustment systems also usually employ a hydraulic motor that effects the trim and tilt operations of the outboard drive. For this purpose, prior hydraulic motors have included a reversible electric motor that selectively drives a reversible fluid pump. The pump pressurizes or depressurizes the hydraulic actuator for raising or lowering the outboard drive.

In particular, the fluid pump supplies pressurized fluid to various ports of the actuator's closed cylinder, on either side of a piston which slides within the cylinder. The piston forms separate chambers within the cylinder. A conventional seal, such as one or more O-rings, operates between the piston and cylinder bore to prevent flow from between the chambers. The piston moves within the cylinder by pressurizing the chamber on one side of the piston and depressuring the other chamber on the opposite side.

An actuator arm is attached to the piston and to the outboard drive. The other end of the cylinder is attached to a bracket on the watercraft. By pressurizing and depressurizing the chambers within the actuator, the piston and thus the outboard drive can be moved.

The pressures in the cylinder chambers vary greatly depending on whether the propulsion unit is operating in a trim range or in a tilt range. In a tilt range, usually associated with tilting the propulsion unit out of the water, the pump generates a relatively low pressure in the chambers because the only load on the cylinder is the weight of the propulsion unit.

The pump conversely must generate far greater pressure to trim-up the motor because of the load placed on the unit by the propulsion unit. The increase in load results from the thrust of the propulsion unit. That is, a portion of the thrust produced by the propulsion unit acts downward and against the tilt and trim mechanism when trimming up. Higher pressures therefore are required in the cylinder to trim up the motor when running at high speeds (e.g., planning speeds).

When used with pleasure boats (e.g., ski boats, sport boats, run-abouts, and the like), the tilt and trim adjustment systems are designed to trim the outboard drive relatively slowly to prevent drive "pop-up."

Undesirable motor pop-up occurs because the thrust of the propulsion system suddenly decreases as the motor is swung through the tilt range. Within the tilt range, the large pressure built-up within the cylinder rapidly pushes the piston upward and causes the outboard motor to pop-up quickly. Tilt and trim mechanisms used on pleasure type boats thus regulate trim and tilt-up speed.

For commercial applications, however, it often is desirable to quickly raise the outboard drive in order to avoid underwater articles, such as, for example, fishing nets and the like. The hydraulic circuitry employed with tilt and trim mechanisms used in commercial applications therefore permits the outboard drive to be raised quickly.

Because of the differences in the design of the hydraulic circuitry, it previously has not been easy to convert a tilt and trim adjustment system for commercial applications. For instance, U.S. Pat. No. 3,842,789 discloses a valve system which permits quick tilt and trim movement of an outboard drive unit; however, this system requires the manual control of a remote operator in order to actuate the valve and quickly raise the outboard drive.

SUMMARY OF THE INVENTION

An aspect of the present invention involves a tilt and trim adjustment system for an outboard drive. The tilt and trim adjustment system comprises at least one actuator that is connected to the outboard drive and that includes first and second chambers. A reversible pump is connected to each of the first and second actuator chambers to supply pressurized working fluid to the actuator chambers. A flow control mechanism operates between the pump and the actuator chambers, and a bypass line interconnects the first and second chambers. The flow control mechanism communicates with the bypass line and with the first actuator chamber. The flow control mechanism also has at least three operational states in response to differing operational modes of the pump. In a first operational state, the flow control mechanism opens the bypass line to permit fluidic communication between the first and second actuator chambers. The first operational state is established by fluidic pressure supplied by the pump to the first actuator chamber. In a second operational state, the flow control mechanism closes the bypass line to allow working fluid to flow from the first actuator chamber to the pump. The second operational state is established by fluidic pressure supplied by the pump to the second actuator chamber. And in a third operational state, the flow control mechanism inhibits the flow of working fluid through the flow control mechanism when the pump is inactive.

In some applications, the bypass line and valve can permit communication between the cylinder chambers when raising the outboard drive to increase the trim and tilt speed of the outboard drive. As a result, this operation is quickened. In addition, the flow control mechanism desirably is constructed in a compact assembly which can be readily integrated into a stem drive unit or an outboard motor.

Importantly, the flow control mechanism operates entirely by pressure changes within the hydraulic circuit due to the operational mode of the pump. The flow control mechanism therefore is easily installed and does not require manual operation.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present tilt and trim adjustment system. The illustrated embodiment is intended to illustrate, but not to limit the invention. The drawings contain the following figures.

DETAILED DESCRIPTION OF PREFERRED EMBODIMENTS OF THE INVENTION

Figure 1:
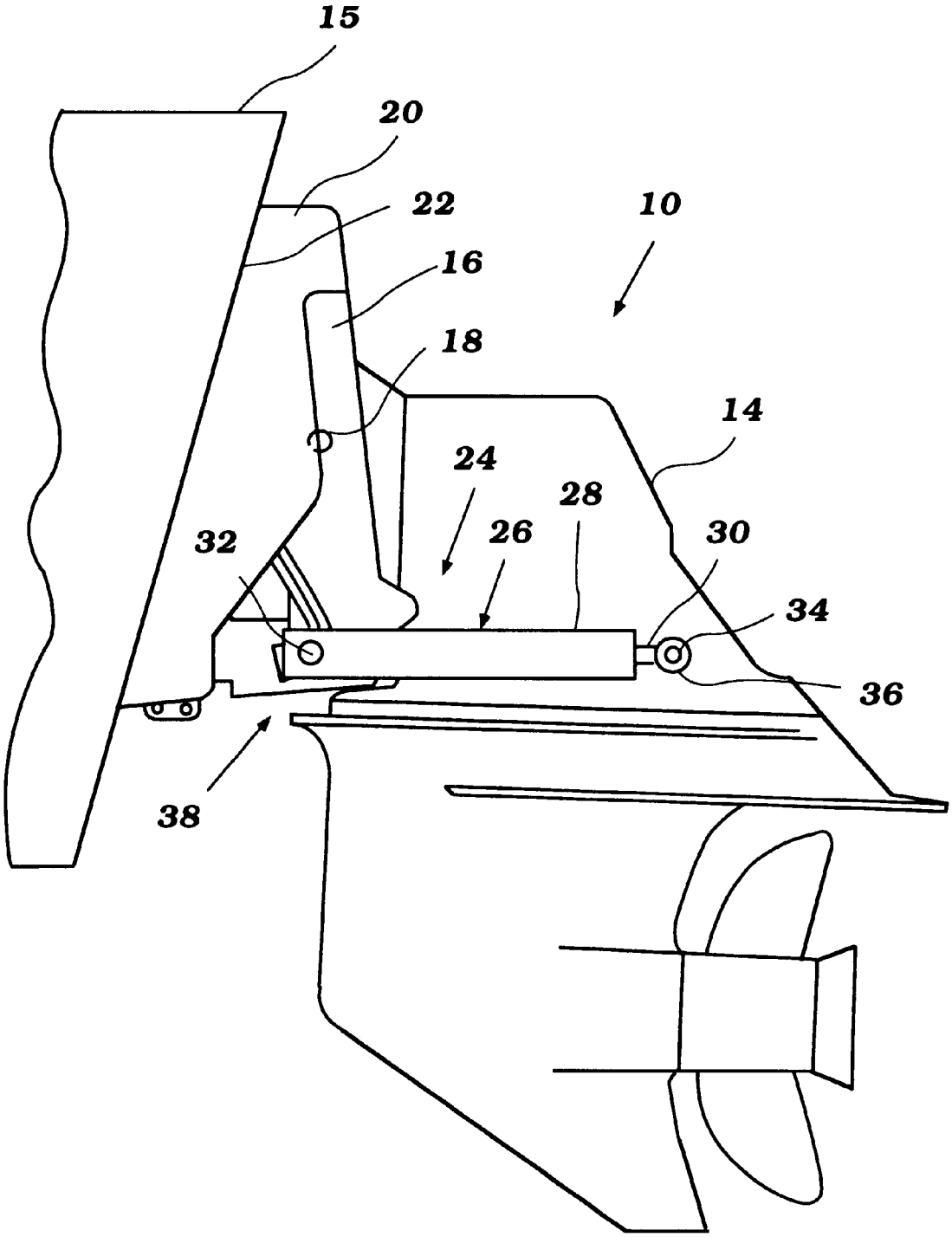
FIG. 1 is a side elevational view of an outboard drive, which includes a hydraulic tilt and trim adjustment mechanism configured in accordance with a preferred embodiment of the invention. The outboard motor is illustrated as attached to the transom of an associated watercraft.

FIG. 1 illustrates a marine outboard drive 10 together with a trim and tilt adjustment system 12 that is configured in accordance with a preferred embodiment of the present invention. In the illustrated embodiment, the outboard drive 10 is depicted as a stem drive unit of an inboard-outboard motor. It is contemplated, however, that the present invention can be used with outboard motors as well. Accordingly, as used herein, the term "outboard drive" shall include stem drives, outboard motors, and similar marine drive units.

The stem drive unit 10 illustrated in FIG. 1 is exemplary. An outer housing 14 of the stem drive 10 is connected to a gimbal housing 16, that encloses a conventional gimbal ring. The gimbal ring connects the stem drive housing 14 to the watercraft 15 and allows the stem drive 10 to rotate about a vertical axis for steering purposes, as well as to pivot about a lateral axis 18 to tilt and trim the stem drive 10, as known in the art. The gimbal ring and housing 16 are attached to a stem plate 20, which in turn is mounted onto a transom 22 of the watercraft 15.

The tilt and trim adjustment system 12 desirably includes a hydraulic motor assembly, indicated generally by reference numeral 24. In the illustrated embodiment, the hydraulic motor assembly 24 includes a pair of tilt and trim cylinders 26 that extend between the stem drive outer housing 14 and the gimbal housing 16. Each cylinder 26 includes a cylinder body 28 in which a piston slides. An actuator arm 30 is attached to the piston and extends beyond one end of the cylinder body 28. A conventional pivot connection 32 couples the body 28 of each cylinder 26 to gimbal housing 16, and another conventional pivot 34 connection couples a tunnion 36 at the end of the actuator arm 30 to the outer housing 14 of the stem drive unit 10.

A powering assembly of the tilt and trim adjustment system 12, which is indicated generally by reference numeral 38, powers the cylinders 26 to raise and lower the stem drive unit 10. The powering assembly desirably includes a reversible electric motor (not shown) that drives a reversible pump 40 (FIG. 2) and a flow control mechanism that control the flow of working fluid (e.g., hydraulic fluid) to and from the cylinders 26. The flow control mechanism desirably is conveniently located on an underside of the gimbal ring housing 16 with the pump and motor located within the hull of the watercraft 15.

Figure 2:
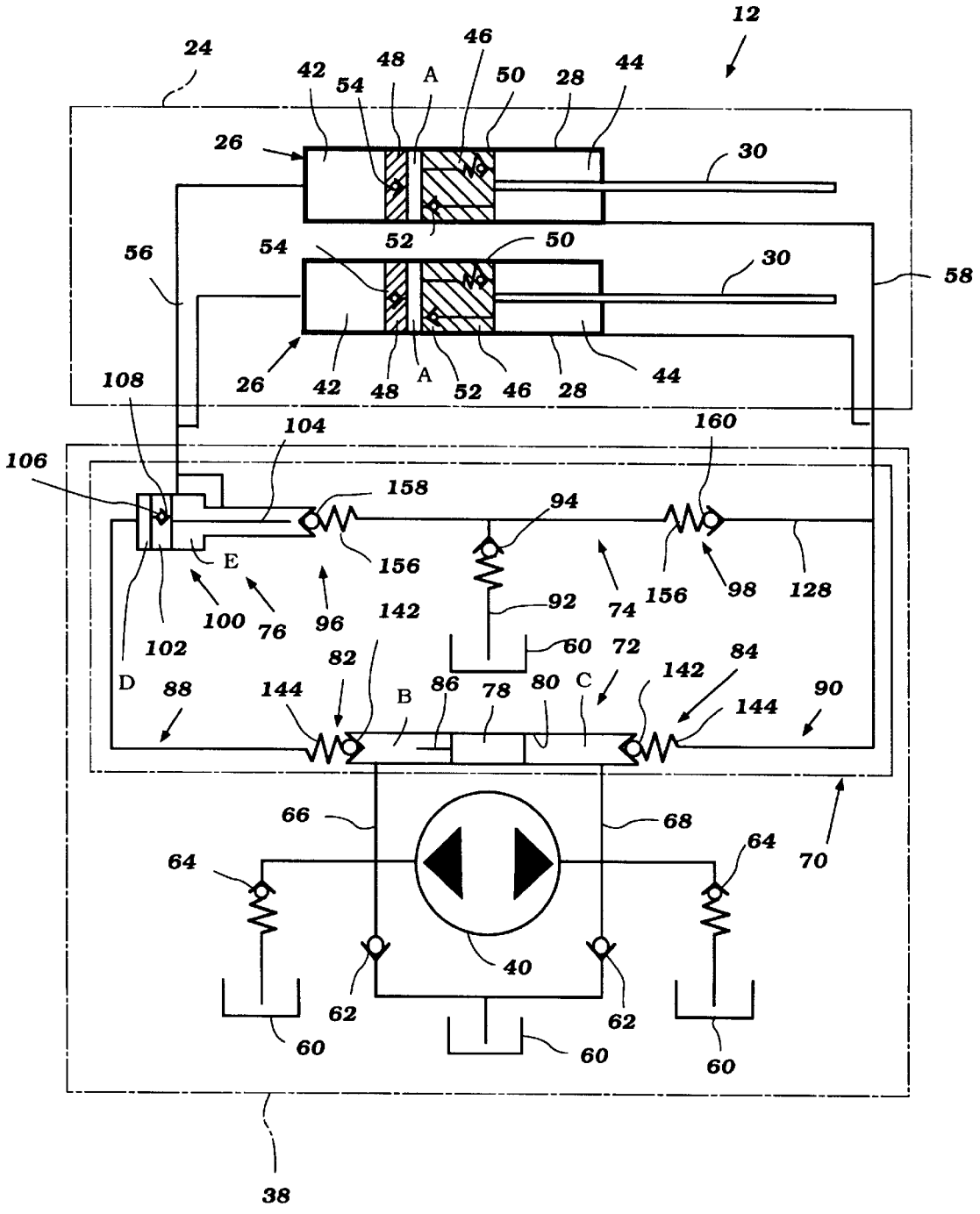
FIG. 2 is a schematic drawing of the hydraulic circuitry of the tilt and trim adjustment system of the present invention.

FIG. 2 schematically illustrates the internal construction of the cylinders 26 of the hydraulic motor assembly 24. The body 28 of each cylinder forms two variable volume chambers on either side of the piston. One chamber, an up chamber 42, is defined to a side of the piston opposite of the actuator rod 30, while the other chamber, a down chamber 44, is defined to the same side of the piston as the actuator rod 30. The actuator rod 30 thus extends through the down chamber 44 of the cylinder and beyond a free end of the cylinder body 28.

In the illustrated embodiment, the motor assembly 24 desirably provides hydraulic damping, in addition to tilt and trim adjustment of the stem drive unit 10. The damping or shock-absorbing operation allows the drive unit 10 to pop-up if it strikes an underwater object so as to prevent damage. This feature is achieved by providing a compound piston formed by an active piston 46 and a free piston 48. The active piston 46 lies adjacent to the down chamber 44 and is connected to the actuator rod 30. The free piston 48 lies adjacent to the up chamber 42. A passage is provided in the active piston to permit flow from the down chamber to a region A between the pistons. The passage includes a pressure responsive absorber valve 50 (e.g., a check valve) that permits flow in response to a predetermined force tending to cause the stem drive unit 10 to tilt or pop-up. The amount of force necessary to open the valve 50 is set to a desired valve, as well known in the art. Return flow from the region A between the active and free pistons 46, 48 to the down chamber 44 is permitted by opening a return passage in the active piston. A one-way, pressure-relief valve 52 regulates flow through the return passage. The free piston 48 also includes a pressure relief passage that is regulated by a pressure- relief valve 54. This passage permits the flow of working fluid from the region A between the pistons 46, 48 to the up chamber 42 should the normal return passage become blocked; however, this passage normally remains closed.

During a pop-up occurrence of the stem drive 10, the free piston 48 remains stationary. By remaining in place, the free piston 48 serves as a memory device for the cylinder 26 so that the active piston 46 can return to the same trim setting as before it struck the underwater object.

The cylinders 26 of the motor assembly 24 desirably are arranged within the hydraulic circuit in parallel. That is, the up chambers 42 of the cylinders 26 are connected to a common pressure line 56, and the down chambers 44 of the cylinders 26 are connected to a common pressure line 58. In this manner, the cylinders 26 desirably move in unison.

FIG. 2 also schematically illustrates the hydraulic circuitry of the powering assembly 38 that powers and controls the hydraulic motor assembly 24. As mentioned above, the powering assembly 38 includes a reversible, positive displacement pump 40 that is driven by a reversible electric motor (not shown). The pump 40 includes a pair of inlet lines that extend from a sump 60 and in which respective non-return check valves 62 are provided. A pump relief valve 64 is provided in a line that communicates the junction of each supply line and each corresponding delivery line 66, 68 to prevent the occurrence of abnormally high pressure within the pump 40 or in the associated supply and delivery lines 66, 68. The relief valves 64 on each side of the pump 40 open into the sump 60.

A flow control mechanism, which is indicated generally by reference numeral 70, control the flow of working fluid between the cylinders 26 and the pump 40. The flow control mechanism 70 is principally operated by the pressure of the working fluid provided by the pump 40. No external actuating mechanism is required (except for operation of a manual override valve which is described below). The flow control mechanism 70 principally comprises a main valve assembly 72, which is connected to the cylinder chambers 42, 44, a bypass line 74 that is connected to the cylinder chambers 42, 44 independent of the main valve 72, and a bypass valve assembly 76. The bypass valve assembly 76 regulates flow through the bypass line 74, as described below.

The main valve assembly, indicated generally by reference numeral 72, is provided downstream of the pump 40. In the illustrated embodiment, the main valve assembly 72 comprises a shuttle-type valve and includes a shuttle piston 78 that divides an interior chamber 80 of the shuttle valve 72 into two chambers: an up chamber B and a down chamber C. The pump 40 selectively delivers pressurized fluid to the up chamber B through the first delivery line 66 and receives the working fluid from the up chamber B through this same line. The down chamber C communicates with the opposite side of the pump through the second delivery line 68.

A first check valve 82 regulates flow through a port on the shuttle valve that communicates with the up chamber 42 of each cylinder 26. In a similar manner, a second check valve 84 controls fluid flow to and from the down chambers 44 of the cylinders 26. The shuttle valve piston 78 has an outwardly extending pin projection 86 that is adapted to engage the first check valve 82 to open the first check valve 82, as will become apparent.

A first pressure line 88 extends from the shuttle valve up chamber B to the lower side of the pressure line 56 connected to the up cylinder chambers 42. A second pressure line 90 connects the shuttle valve down chamber C with the second pressure line 58, which in turn is connected to the actuator cylinders 26 on a side above the respective active piston 46 and in communication with the down cylinder chamber 44.

As mentioned above, the hydraulic circuit of the powering assembly 38 includes the bypass line 74. The bypass line 74 connects together the first and second pressure lines 56, 58. The bypass line 74 also communicates with the sump 60 through a relief line 92. A manual override valve 94 normally prevents fluid communication through the bypass line 92 to the sump 60; however, when the valve 94 is manually opened, the bypass line 74 places the cylinder chambers 42, 44 in communication with the sump 60. The stern drive unit 10 then can be raised or lowered manually.

The powering assembly 38 also includes the bypass valve assembly 76 which regulates the flow of working fluid through the bypass line 74 and between the cylinder chambers 42, 44. The bypass valve assembly 76 in the illustrated embodiment includes third and fourth check valves 96, 98 which are arranged within the bypass line 74 on either side of the relief line 92. A shuttle valve 100 of the bypass valve assembly 76 also is arranged to selectively open the third check valve 96.

In the illustrated embodiment, the bypass shuttle valve 100 principally lies at the intersection of the bypass line 74 and the first pressure line 88; however, it is understood that other locations within the hydraulic circuit also may be possible. The shuttle valve 100 includes a shuttle piston 102 that divides the interior of the shuttle valve into first and second chambers D, E. The first chamber D communicates with the pressure line 88 on the pump side of the valve 100. The second chamber E communicates with the up cylinder chambers 42 of the tilt and trim cylinders 26, as well as communicates with the bypass line 74 through the third check valve 96. The shuttle piston 102 includes an outwardly extending pin projection 104 that is adapted to engage and open the third check valve 96, as will become apparent. The shuttle piston 102 also includes a return passage 106 through the body of the piston 102. A one-way, pressure-responsive valve 108 regulates flow through the return passage 106, as will be described below.

Figure 3:
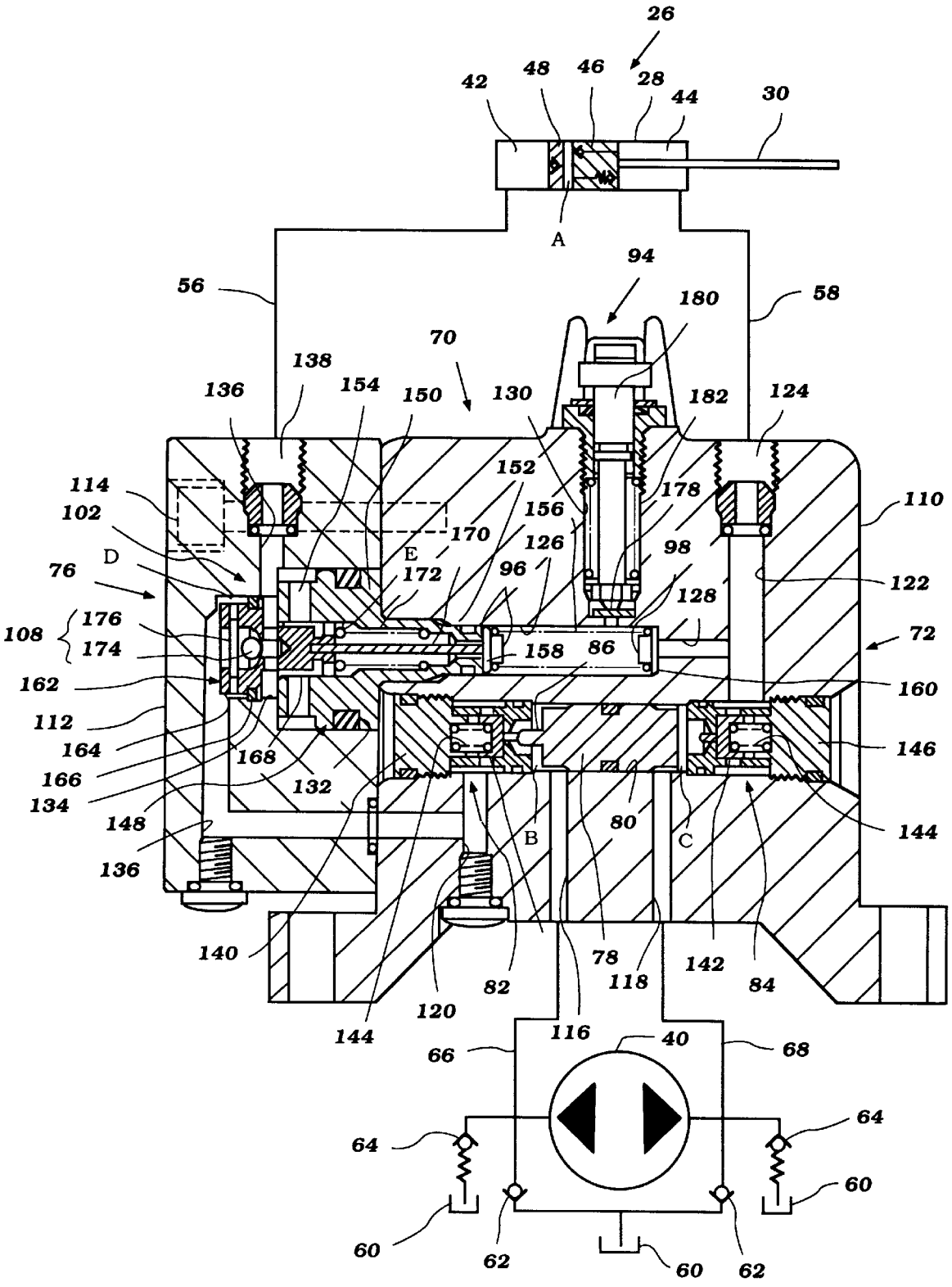
FIG. 3 is an enlarged cross-sectional view of a valve assembly of the tilt and trim system schematically illustrated in FIG. 2.

FIG. 3 illustrates the construction of the flow control mechanism in accordance with a preferred embodiment of the present invention. (The pump 40, as well as only one cylinder 26, are schematically illustrated in order to simplify the drawing while still providing a reference of the flow control mechanism within the hydraulic circuit.) The flow control mechanism 70 desirably includes a main body 110 and a side body 112 which is attached to the main body 110 by one or more fasteners (e.g., bolts) 114.

The main body 110 includes the main valve chamber 80 which is located toward a pump side of the body 110. Generally parallel delivery passages 116, 118 extend from the pump side of the body 110 and open into the main valve chamber 80. Each delivery passage 116, 118 communicates with one side of the pump 40 and communicates with the main valve chamber 80 at separate locations.

A first pressure passage 120 extends between the main valve chamber 80 and a side of the main body 110. The point at which the first pressure passage 120 opens into the valve chamber 80 lies to one side of the delivery passages 116, 118. And the point at which the first pressure passage 120 terminates at the side of the main body 110 lies near the pump side of the main body 110. Thus, in the illustrated embodiment, the first pressure passage 120 includes a first section that extends generally parallel to the delivery passages 116, 118 and a second section that extends generally parallel to the main valve chamber 80. The first pressure passage forms a portion of the pressure line 88 (FIG. 2).

A second pressure passage 122 extends between the main valve chamber 80 and a port 124 formed on the cylinder side of the body 110. The second pressure passage 122 and the port 124 together form the second pressure line 90 (FIG. 2) of the flow control mechanism 70. The point at which the pressure passage 122 opens into the valve chamber 80 lies to the other side of the delivery passages 116, 118. In the illustrated embodiment, the second pressure passage 122 lies on a side of the main valve chamber 80 opposite of the first pressure passage 120 and extends in a direction generally normal to an axis of the main valve passage 80.

The main valve body 110 also includes a bypass valve chamber 126. In the illustrated embodiment, the bypass valve chamber 126 lies generally parallel to the main valve chamber 80 and generally normal to the second pressure passage 122. The bypass valve chamber 126 is smaller than the main valve chamber 80, and extends only partially into the main body 110 from the side on which the first pressure passage 120 terminates.

A small passage 128 interconnects the bypass valve chamber 126 and the second pressure passage 122. Together the small passage 128 and a portion of the bypass valve chamber 126 form the bypass line 74, as will be apparent from the following description.

A manual valve chamber 130 also intersects with the bypass valve chamber 126. In the illustrated embodiment, the manual valve chamber 130 lies generally parallel to the second pressure passage 122 and generally normal to the bypass valve chamber 126. The manual valve chamber 130 terminates on the cylinder side of the main body 110.

The side or bypass valve body 112 includes a valve receptacle cavity 132 arranged so as to cooperate with the bypass valve chamber 126 of the main body 110 when the main and side bodies 110, 112 are connected. The valve receptacle cavity 132 is larger than the bypass valve chamber 126.

A smaller diameter bore 134 also is formed within the side body 112. The bore 134 desirably is located adjacent to and concentric with the valve receptacle cavity 132.

A pressure passage 136 passes through the side body 112. A first section of the pressure passage 136 extends into the side body from an inner surface and originates at a point that corresponds to the terminal port of the first pressure passage 120 of the main body 110 when the bodies 110, 112 are attached. In the illustrated embodiment the first section of the pressure passage 136 in the side body 112 and the second section of the first pressure passage 120 of the main body 110 are generally coaxial when the flow control mechanism 70 is assembled.

A second section of the pressure passage 136 extends through the side body 112 in a direction generally normal to the first section. The second section interconnects the first section and the small diameter bore 134 that lies adjacent to the valve receptacle cavity 132.

A third section of the pressure passage 136 extends from the cylinder side of the side body 112 and intersects with both the small diameter bore 134 and the valve receptacle cavity 132, as seen in FIG. 3. The third section terminates at a port 138 to which the pressure line 56 is connected. The opposite end of the pressure line 56 communicates with the up chambers 42 of the cylinders 26.

The main and side bodies 110, 112 house the main valve assembly 72, the bypass valve assembly 76 and the manual relief valve assembly 94. As seen in FIG. 3, the first check valve 82 is arranged at the intersection between the main valve chamber 80 and the first pressure passage 120. The first check valve body is held between a plug 140 and an annular step formed within the main valve chamber 80. The first valve 82 includes a housing which supports an axially movable disc 142. A spring 144 normally biases the disc 142 against a seal plate of the housing. The seal plate includes an orifice which communicates with the first chamber B of the shuttle valve 72. A protuberance extends inward of the front plate from the disc 142. The housing also includes a second orifice which communicates with the first pressure passage 120. When the disc 142 is moved so as to compress the spring 144, the orifices communicate with each other through an internal passage within the valve housing.

Likewise, the second check valve 84 is arranged at the intersection between the main valve chamber 80 and the second pressure passage 122. The second check valve body is held between a plug 146 and an annular step formed within the main valve chamber 80. The second check valve 84 has a similar construction to the first check valve 82, and the above description applies equally to the second check valve 84. Like reference numerals therefore have been used to indicate the common components between the first and second check valves 82, 84.

The shuttle 78 is located within the main valve chamber 80 between the first and second check valves 82, 84 and generally between the openings to the delivery passages 116, 118. The ends of the shuttle 78 have reduced cross-sectional shapes to form a space between the shuttle body and the side wall of the valve chamber 80 at the openings to the delivery passages 116, 118. In this manner, working fluid can flow between the first chamber B of the valve 72 and the first delivery passage 116 and between the second chamber C of the valve 72 and the second delivery passage 118. A seal circumscribes the shuttle 78 to prevent communication between the first and second valve chambers B, C, however.

The bypass valve 76 is arranged within the small bore 134 and valve receptacle cavity 132 of the side body 112 and the bypass valve chamber 126 of the main body 110. The bypass valve 76 includes a valve guide 148 which is positioned within the valve receptacle cavity 132 and extends into the valve chamber 126. The valve guide 148 is secured in place with its perimeter being sealed within the cavity 132 by a seal ring.

The valve guide 148 includes a plug section 150 which is disposed within the receptacle cavity 132 and a tubular section 152 which extends into the valve chamber 126. An inner passage E extends through the valve guide generally along its longitudinal axis. The valve guide 148 also includes an auxiliary passage 154 located near the end of the plug section 150. The auxiliary passage 154 is formed by a reduced diameter section at the end of the plug 150 and a transverse hole which extends through the plug 150 in a direction generally normal to the longitudinal axis of the valve guide 148.

The third check valve 96 is positioned at the end of the valve guide 148 within the valve chamber 126. And the fourth check valve 98 is positioned on the other end of the valve chamber 126 at the junction between the valve chamber 126 and the short passage 128. A compression spring 156 operates between the discs 158, 160 of the third and forth check valves 96, 98 and biases the discs 158, 160 to normally close the junction between the short passage 128 and the valve chamber 126 and the junction between the valve chamber 126 and the inner passage E within the valve guide 148.

The shuttle 102 of the bypass valve 76 operates within the small bore 134 of the side body 112 and within the valve guide 148. As seen in FIG. 3, the shuttle 102 includes a valve disc 162 which is sized to slide within the small bore 134. One end of the disc includes a reduced diameter portion 164, and a seal ring 166 circumscribes the other end of the disc which is next to the valve guide 148.

A guide rod 168 extends outward from the valve disc 162 and into the inner passage E of the valve guide 148. The guide rod 168 is sized so as to smoothly slide within the inner passage E of the valve guide 148. A rod 170 projects from the guide rod 168 toward the third check valve 96. The rod 170 has a sufficient length to just contact the disc 158 of the third check valve 96 when the valve disc 162 resides at the bottom of the small bore 134. A compression spring 172 is located between the guide rod 168 and an inner shoulder of the valve guide 148. The spring 172 desirably is preloaded so as to bias the valve disc 162 toward the bottom of the small bore 134.

The shuttle 102 also includes the internal flow passage 106, as mentioned above. The passage 106 extends through the valve disc 162 in a direction parallel to a longitudinal axis of the shuttle 102, and then transversely through the guide rod 168. This passage forms a flow path through the shuttle 102 and between the second and third sections of the pressure passage 136 in the side body 112 when the valve disc 162 is biased against the bottom of the small bore 134.

The check valve 108 desirably operates within the flow passage 106 through the shuttle 102. In the illustrated embodiment, the check valve 108 includes a ball 174 arranged within the valve disc 162 and positioned to seat against a valve seat. The valve seat is arranged between the longitudinal and transverse sections of the passage 106. A pin 176 maintains the ball 174 within the passage 106 through the valve disc 162.

As also seen in FIG. 3, the manual valve 94 is arranged within the manual valve chamber 130. The manual valve 94 includes a valve plate 178 that lies across an orifice that connects the manual valve chamber 130 to the bypass valve chamber 126. A rod 180 of the valve 94 normally contacts the valve plate 178 and hold the plate 178 over the orifice. A spring 182 biases the rod 180 into contact with the plate 178. When manually operated, the rod 180 is retracted to compress the spring 182. The valve plate 178 then can unseat to allow the flow of working fluid through the manual valve 94 and the relief line 92 (FIG. 2).

The operation of the flow control mechanism 70 will now be described with principal reference to FIGS. 2 and 3. The pump 40 supplies pressurized working fluid to the up chambers 42 of the cylinders 26 as well as to the flow control mechanism 70 when raising the outboard drive 10. The pump 40 is run in a direction or operational mode to pressurize the first delivery line 116. Under this operational mode, the pressurized fluid supplied by the pump 40 causes the flow control mechanism 70 to assume a first operational state. The pump draws working fluid from the sump 60 through the check valve 62 in the pick-up line as the second check valve 84 remains closed with the flow control mechanism 70 within the first operational state. The first chamber B of the main valve 72 pressurizes and the first check valve 82 opens as a result. Notably, the shuttle 78 does not open the second check valve 84 when the first chamber B is pressurized. The pump 40 then delivers working fluid through the pressure passages 120, 136 downstream of the first check valve 82.

The pressurized working fluid also forces open the bypass valve 76. The bypass valve shuttle 102 is forced against the end of the valve guide 148. In this position, a flow path is formed through the small bore 134 around small diameter portion 164 of the valve disc 162. The working fluid thus can flow into the third section of the pressure passage 136 and into the pressure line 56 that communicate with the up chambers 42 of the cylinders 26.

The working fluid in the down cylinder chambers 44 flows through the bypass line 74 to the up cylinders 42 in the present hydraulic circuit, rather than to the pump. The working fluid in the down chambers 44, which is pressurized by the corresponding movement of the pistons 46, 48, forces open the fourth check valve 98 and flows into the bypass valve chamber 126 through the short passage 128.

The rod 170 of the bypass valve shuttle 102 forces open the third check valve 96 when the valve disc 162 is forced against the valve guide 148. The working fluid can then flow through the third check valve 96, through the inner passage E and the auxiliary passage 154 of the valve guide 148 and into the pressure passage 136 connected to the cylinder up chambers 42. The cylinders 26 can rise quicker as a result of the "short circuit" provided by the open bypass line 74.

The pump 40 operates in reverse (i.e., in an opposite operational mode) to lower the outboard drive 10. Assuming that the outboard drive is in a raised position, the pistons 46, 48 in each cylinder 26 lie away from the corresponding port to the up chamber 42. If the operator decides to tilt or trim the outboard drive 10 down, the electric motor (not shown) is energized so as to drive the pump 40 in a direction that pressurizes the second delivery line 118 and causes the first delivery line 116 to function as a pump return line. Under this operational mode, the pressurized fluid supplied by the pump 40 causes the flow control mechanism 70 to assume a second operational state. Pressure in the first delivery line 116 will also be created by the weight of the outboard drive 10 and by any thrust produced by the outboard drive 10 during the tilt or trim down operation.

When the second delivery line 118 is pressurized, the pressure in the second chamber C of the shuttle valve assembly 72 shifts the shuttle 78 toward the first pressure passage 120 thereby unseating the first check valve 82. The pressure in the second chamber C is also sufficient to unseat the second check valve 84 thus allowing fluid to flow from the chamber C, through the second pressure passage 122 in the main body 110 and into the pressure line 58 connected to the down chambers 44 of the cylinders 26. Accordingly, the pistons 46, 48 are forced downward toward a lower end of the respective cylinder 26 to tilt or trim down the outboard drive 10.

Although the pressure within the second pressure passage 122 under this pump operation mode may also open the fourth check valve 98, the third check valve 96 remains closed to prevent working fluid flow through the bypass line 74. The bypass valve spring 172 biases the valve disc 162 against the bottom of the small diameter bore 134 when unopposed by pressure within the second section of the pressure passage 136. In this position, the rod 170 does not displace the valve disc 158 of the third check valve 96. The spring 156 between the third and fourth check valve discs 158, 160 holds the third valve 96 closed under these conditions.

During downward movement of the upper and lower pistons 46, 48 a quantity of fluid is expelled from within the up cylinder chamber 42 of each cylinder 26 through the respective port to the line 56 and into the pressure passage 136 of the side body 112. The working fluid then flows through the transverse section of the passage 106 through the bypass valve disc 162, and forces open the check valve 108 within the passage 106. With the valve disc check valve 160 open, the working fluid flows through the valve disc 162 and into the second and first sections of the pressure passage 136 within the side body 112. The fluid then passes through the first pressure passage 120 of the main body 110, through the open first check valve 82 and into the first chamber B of the main valve assembly 72. The pump 40 draws the fluid from the valve 72 and into the first delivery line 116 on the supply side of the pump 40 when operating under this operational mode.

When the pump is inactive (e.g., in a third operational mode), the flow control mechanism 70 assumes a third operational state wherein the bypass valve 76 inhibits flow of working fluid through the hydraulic circuit formed by the flow control mechanism. The spring 172 biases the shuttle 102 of the bypass valve 76 toward the bottom of the small diameter bore 134. In this position, as noted above, the shuttle does not open the third check valve 96. And the spring 156 biases both the third and fourth check valves 96, 98 closed. Working fluid therefore does not pass through the bypass line 74 under this operating condition.

The main valve 72 also remains closed to prevent fluid flow through the first and second pressure lines 88, 90. The springs 144 of the first and second check valves 82, 84 close the valve 82, 84 when the pump does not apply pressure to either of the chambers B, C. The check valve 108 in the bypass valve disc 162 also inhibits a flow of working fluid from the main valve 72 toward the up chambers 42 of the cylinders 26.

The present tilt and trim adjustment system 12 thus allows the outboard drive 10 to be quickly raised by providing an open bypass line 74 between the chambers 42, 44 of the cylinders 26. The bypass line 74, however, is closed when lowering the outboard drive 10 in order to provide greater control and ease adjustment of the outboard drive's tilt or trim position.

The valve assemblies 72, 76 are also compact and integrated, and can be easily mounted near the motor assembly 24 on the outboard drive 10. The system 12 also needs not be linked to the operator that controls the pump motor's function. Thus, the present flow control mechanism 70 can simply and easily convert a tilt and trim adjustment system to quicken the responsiveness when raising the outboard drive 10.

Figure 4:
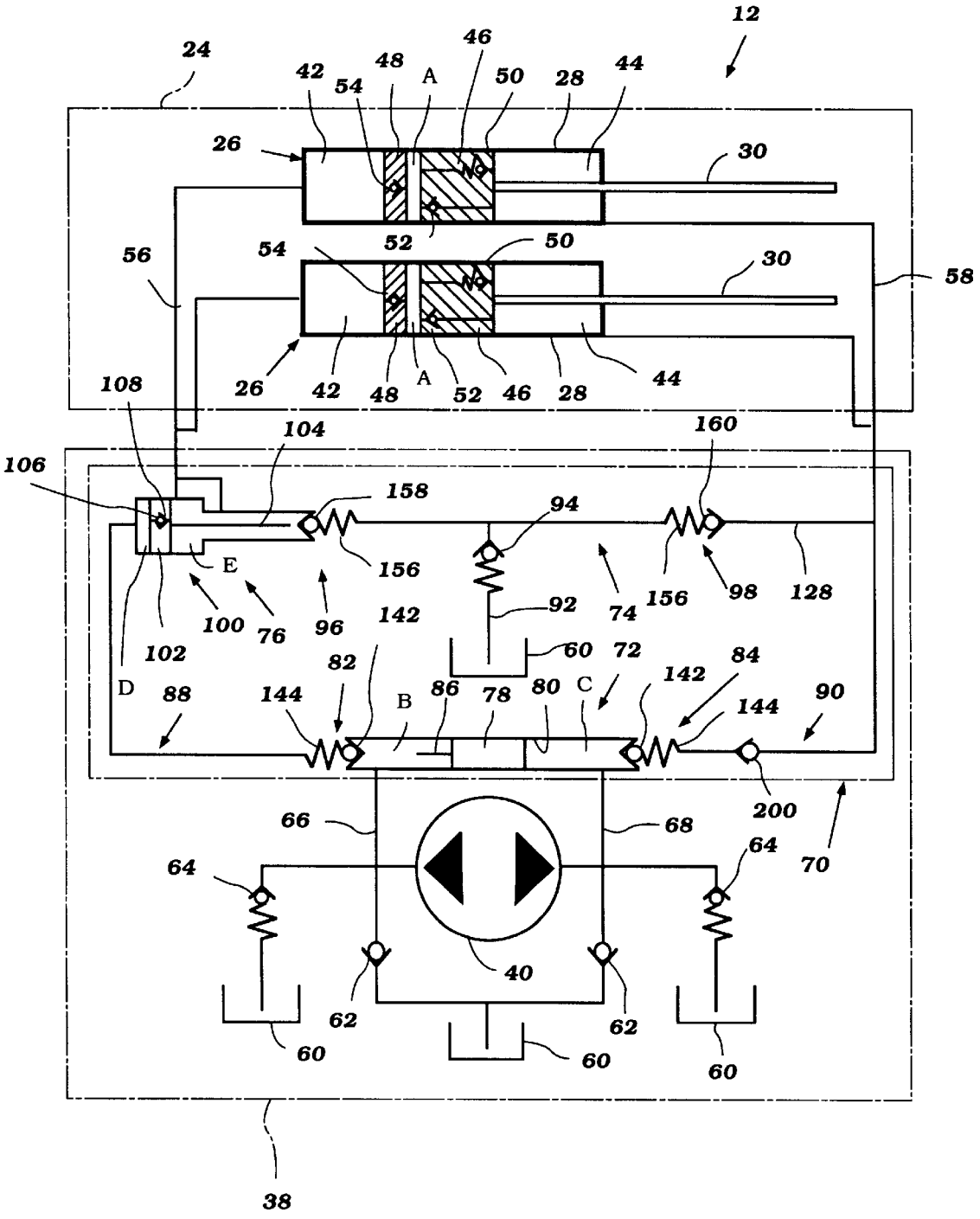
FIG. 4 is a schematic drawing of a hydraulic circuit of a tilt and trim adjustment system configured in accordance with another embodiment of the present invention.

FIG. 4 illustrates another embodiment of the present tilt and trim adjustment system 12. This embodiment is substantially similar than that described above, with the exception of the shuttle 78 of the main valve 72 and the addition of a one-way check valve 200 in the second pressure passage 122. For this purpose, the same reference numerals are used with common elements between the embodiments to indicate their similarity.

The shuttle 78 of the main valve includes projections 86, 202 that extend from either side of the shuttle 78 and that are arranged to open the respective first and second check valves 82, 84 depending upon the operational mode of the pump 40. The valve design 72 therefore is similar to shuttle valves commonly used with tilt and trim adjustment systems. As a result, additional tooling and separate fabrication are not required, thereby reducing the cost of the main valve 72.

The one-way valve 200 is located within the second pressure passage 122 of the main body 110. The one-way valve 200 desirably lies between the second check valve 84 and the junction between the bypass line 74 (i.e., the short passage 128) and the second pressure line 122.

In operation, the main valve 72 functions in the manner described above when lowering the outboard drive 10. The pressure within the second chamber C of the main valve 72 forces open the second check valve 84 and the working fluid flows through the one-way valve 200 and through the second pressure passage 122. The projection 86 of the valve shuttle 78 also opens the first check valve 82.

Unlike the operation of the previous embodiment, the valve shuttle 78 also opens the second check valve 84 when raising the outboard drive 10. The pressure within the first chamber B of the main valve 72 causes the shuttle 78 to slide toward the second check valve 84. The projection 200 contacts the valve disc 142 of the second check valve 84 to open the valve 84. The second delivery line 118, however, does not communicate with the second pressure passage 122 because the one-way valve 200 prevents the flow of the working fluid from the down cylinder chambers 44 to the main valve 72. The fluid rather flows through the bypass line 74 in the manner described above in connection with the previous embodiment. The addition of the one-way valve 200 thus allows the valve assemblies 72, 76 to open the bypass line 74 when raising the outboard drive 10 and to close the bypass line 74 when lowering the outboard drive 10. The valve assemblies 72, 76 also inhibit the flow of working fluid through the flow control mechanism 70 when the pump is inactive. The aforementioned advantages are thereby achieved with this embodiment while also obtaining the fabrication cost savings noted above.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A tilt and trim adjustment system for an outboard drive comprising at least one actuator connected to the outboard drive, said actuator including first and second chambers, a pump connected to each of the first and second actuator chambers to supply pressurized working fluid to the actuator chambers, a main valve assembly arranged between the actuator and the pump and selectively placing the pump in communication with at least one of the actuator chambers, a bypass line interconnecting the first and second chambers independent of the main valve assembly, and a bypass valve assembly communicating with the bypass line and with at least the first actuator chamber and being operated between at least three operational states, the bypass valve assembly in a first operational state opening the bypass line to permit fluidic communication between the first and second actuator chambers, the first operational state being established by fluidic pressure supplied by the pump to the first actuator chamber, the bypass valve assembly in a second operational state closing the bypass line to allow working fluid to flow from the first actuator chamber to the pump, said second operational state being established by fluidic pressure supplied by the pump to the second actuator chamber, and the bypass valve assembly in a third operational state inhibiting the flow of working fluid through the bypass valve assembly when the pump is inactive.

2. A tilt and trim adjustment system as in claim 1, wherein said bypass valve assembly is normally biased to establish the third operational state.

3. A tilt and trim adjustment system as in claim 1, wherein the main valve is arranged to open communication between the pump and the first actuator chamber and close communication between the pump and the second actuator chamber under a first mode of operation, and to open communication between the pump and both the first and second actuator chambers under a second mode of operation.

4. A tilt and trim adjustment system as in claim 3, wherein said actuator extends under said first mode of operation with said bypass valve assembly positioned in the first operational state.

5. A tilt and trim adjustment system as in claim 4, wherein said actuator retracts under said second mode of operation with the bypass valve assembly positioned in the second operational state and the main valve placing the first actuator chamber in communication with a suction side of the pump and the second actuator chamber in communication with a pressure side of the pump.

6. A tilt and trim adjustment system as in claim 5, wherein the main valve includes first and second check valves and a shuttle, the first check valve is arranged to inhibit a flow of working fluid from the first actuator chamber to the pump, and the second check valve is arranged to inhibit a flow of working fluid from the second actuator chamber to the pump, and the shuttle is arranged to open the first check valve under the second operational mode.

7. A tilt and trim adjustment system as in claim 6, wherein the bypass valve assembly includes a third check valve, a fourth check valve and a shuttle, the third check valve is arranged to inhibit a flow of working fluid through the bypass line to the first actuator chamber, and the fourth check valve is arranged to inhibit a flow of working fluid through the bypass line to the second actuator chamber, and the shuttle is arranged to open the third check valve under the first operational mode.

8. A tilt and trim adjustment system as in claim 7, wherein the shuttle is arranged to close the third check valve under the second operational mode.

9. A tilt and trim adjustment system as in claim 6, wherein the shuttle of the main valve assembly is also arranged to open the second check valve under the first operational mode, and the main valve assembly includes another check valve which is arranged between the second check valve and the second actuator chamber to inhibit a flow of working fluid from the second actuator chamber to the pump under the first operational mode.

10. A tilt and trim adjustment system as in claim 1, wherein the main valve assembly is constructed in a first valve body and the bypass valve assembly is principally constructed within a second valve body, and the second valve body is removably attached to the first valve body.

11. A tilt and trim adjustment system for an outboard drive comprising at least one actuator connected to the outboard drive, said actuator including first and second chambers, a reversible pump connected to each of the first and second actuator chambers to supply pressurized working fluid to the actuator chambers, a flow control mechanism operating between the pump and the actuator chambers, and a bypass line interconnecting the first and second chambers, said flow control mechanism communicating with the bypass line and with the first actuator chamber, and having at least three operational states in response to differing operational modes of the pump, said flow control mechanism in a first operational state opening the bypass line to permit fluidic communication between the first and second actuator chambers, the first operational state being established by fluidic pressure supplied by the pump to the first actuator chamber, the flow control mechanism in a second operational state closing the bypass line to allow working fluid to flow from the first actuator chamber to the pump, said second operational state being established by fluidic pressure supplied by the pump to the second actuator chamber, and the flow control mechanism in a third operational state inhibiting the flow of working fluid through the flow control mechanism when the pump is inactive.

12. A tilt and trim adjustment system as in claim 11, wherein said flow control mechanism includes a main valve assembly arranged between the actuator and the pump and selectively places the pump in communication with at least one of the actuator chambers.

13. A tilt and trim adjustment system as in claim 12, wherein the main valve is arranged to place a pressure side of the pump in communication with the first actuator chamber and to close communication between a suction side of the pump and the second actuator chamber under a first mode of operation of the pump, and to place a pressurized side of the pump in communication with the second actuator chamber and to open communication between a suction side of the pump and the first actuator chamber under a second mode of operation of the pump.

14. A tilt and trim adjustment system as in claim 13, wherein said flow control mechanism additionally comprises a bypass valve assembly communicating with the bypass line and with the first valve assembly.

15. A tilt and trim adjustment system as in claim 14, wherein the main valve includes first and second check valves and a shuttle, the first check valve is arranged to inhibit a flow of working fluid from the first actuator chamber to the pump, and the second check valve is arranged to inhibit a flow of working fluid from the second actuator chamber to the pump, and the shuttle is arranged to open the first check valve with the pump operating in its second operational mode.

16. A tilt and trim adjustment system as in claim 15, wherein the bypass valve assembly includes a third check valve, a fourth check valve and a shuttle, the third check valve is arranged to inhibit a flow of working fluid through the bypass line to the first actuator chamber, and the fourth check valve is arranged to inhibit a flow of working fluid through the bypass line to the second actuator chamber, and the shuttle is arranged to open the third check valve with the pump operating in its first operational mode.

17. A tilt and trim adjustment system as in claim 16, wherein the shuttle is arranged to close the third check valve under the second operational mode.

18. A tilt and trim adjustment system as in claim 15, wherein the shuttle of the main valve assembly is also arranged to open the second check valve under the first operational mode, and the main valve assembly includes another check valve which is arranged between the second check valve and the second actuator chamber to inhibit a flow of working fluid from the second actuator chamber to the pump under the first operational mode.

19. A tilt and trim adjustment system as in claim 14, wherein the flow control mechanism includes a main valve body in which the main valve assembly is constructed and a bypass valve body in the bypass valve assembly is principally constructed, and the bypass valve body is removably attached to the main valve body.

20. A tilt and trim adjustment system as in claim 11, wherein the flow control mechanism is normally biased to establish the third operational state.

* * * * *